US007121203B2

(12) United States Patent
Pickering et al.

(10) Patent No.: US 7,121,203 B2
(45) Date of Patent: Oct. 17, 2006

(54) APPARATUS AND METHOD OF TREATING A RECORDING ELEMENT

(75) Inventors: James E. Pickering, Bloomfield, NY (US); Arthur M. Gooray, Penfield, NY (US); Timothy J. Wojcik, Rochester, NY (US); Hwei-Ling Yau, Rochester, NY (US); Po-Jen Shih, Webster, NY (US); James A. Reczek, Rochester, NY (US); Simon Yandila, Rochester, NY (US); Charles F. Scaglione, Bergen, NY (US); Kwok-Leung Yip, Webster, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/731,335

(22) Filed: Dec. 9, 2003

(65) Prior Publication Data

US 2005/0122382 A1 Jun. 9, 2005

(51) Int. Cl.
*B41M 7/00* (2006.01)
*B41J 2/01* (2006.01)
*B41J 29/00* (2006.01)

(52) U.S. Cl. ..... 101/424.1; 347/102; 347/101; 347/104; 347/108; 101/487; 101/488

(58) Field of Classification Search ..... 400/120.18; 347/101, 102, 104
See application file for complete search history.

(56) References Cited

U.S. PATENT DOCUMENTS

| | | | | |
|---|---|---|---|---|
| 4,785,313 | A | 11/1988 | Higuma et al. | 347/105 |
| 4,832,984 | A | 5/1989 | Hasegawa et al. | 427/161 |
| 5,041,846 | A * | 8/1991 | Vincent et al. | 346/25 |
| 5,045,888 | A * | 9/1991 | Imaeda | 399/341 |
| 5,160,399 | A * | 11/1992 | Ueda et al. | 156/359 |
| 5,517,214 | A * | 5/1996 | Bhatia et al. | 346/25 |
| 5,650,808 | A * | 7/1997 | Vincent et al. | 347/43 |
| 5,930,551 | A * | 7/1999 | Nakazato et al. | 399/1 |
| 6,092,891 | A * | 7/2000 | Okubo et al. | 347/104 |
| 6,114,020 | A | 9/2000 | Misuda et al. | 428/212 |
| 6,120,199 | A | 9/2000 | Takekoshi | 400/611 |
| 6,283,590 | B1 * | 9/2001 | Peter | 347/102 |
| 6,331,384 | B1 * | 12/2001 | Satoi | 430/347 |
| 6,332,679 | B1 | 12/2001 | Higuma et al. | 347/102 |
| 6,357,871 | B1 | 3/2002 | Ashida et al. | 347/106 |
| 6,390,618 | B1 * | 5/2002 | Wotton et al. | 347/102 |

(Continued)

FOREIGN PATENT DOCUMENTS

EP 1 284 186 A2 2/1916

(Continued)

OTHER PUBLICATIONS

Machine translation of JP 10291304 to Takekoshi et al. from Japanese Patent Office website.*

(Continued)

*Primary Examiner*—Daniel J. Colilla
(74) *Attorney, Agent, or Firm*—William R. Zimmerli

(57) ABSTRACT

An apparatus and method of treating a recording element are provided. The apparatus includes a carrier removal station adapted to remove a predetermined percentage of carrier present in the recording element. A converting station is positioned downstream from the carrier removal station and is adapted to increase a durability characteristic of the recording element. A controller is electrically connected to at least one of the carrier removal station and the converting station so that an operating parameter of at least one of the carrier removal station and the converting station is individually adjustable.

24 Claims, 9 Drawing Sheets

U.S. PATENT DOCUMENTS

| | | | | |
|---|---|---|---|---|
| 6,394,669 | B1 | 5/2002 | Janosky et al. | 396/571 |
| 6,444,379 | B1 * | 9/2002 | Kaneda et al. | 430/22 |
| 6,513,924 | B1 * | 2/2003 | Goldberg et al. | 347/106 |
| 6,679,599 | B1 * | 1/2004 | Jurrens et al. | 347/102 |
| 6,715,870 | B1 * | 4/2004 | Kiene et al. | 347/102 |
| 6,764,174 | B1 * | 7/2004 | Sekiya | 347/102 |
| 2002/0008747 | A1 | 1/2002 | Kaga et al. | 347/102 |
| 2002/0027587 | A1 | 3/2002 | Sugaya et al. | 347/104 |
| 2003/0234847 | A1 * | 12/2003 | Takekoshi et al. | 347/102 |

FOREIGN PATENT DOCUMENTS

| | | | |
|---|---|---|---|
| EP | 0 925 945 | A2 | 6/1990 |
| EP | 0568181 | | 3/1993 |
| EP | 1008450 | | 6/2000 |
| JP | 04021446 | | 1/1992 |
| JP | 10291304 | A * | 11/1998 |
| JP | 2002-283553 | A | 3/2002 |

OTHER PUBLICATIONS

U.S. Appl. No. 10/731,705, in the name of Timothy J. Wojcik, et al., filed concurrently herewith.

* cited by examiner

APPARATUS AND METHOD OF TREATING A RECORDING ELEMENT

CROSS REFERENCE TO RELATED APPLICATIONS

Reference is made to commonly assigned U.S. patent Publication No. 2005/122383 published Jun. 9, 2005, "A RECORDING ELEMENT PRINTING AND TREATING SYSTEM AND METHOD", in the name of Timothy J. Wojcik, et al., filed concurrently herewith.

FIELD OF THE INVENTION

This invention relates generally to an apparatus and method of treating a recording element and, more particularly, to an apparatus and method of treating an imaged and/or printed recording element.

BACKGROUND OF THE INVENTION

Inkjet printing is a non-impact printing method that, in response to a digital signal, produces droplets of ink that are deposited on a recording element. Today, inkjet printing systems are used in a variety of capacities in industrial, home, and office environments. The quality of inkjet prints continues to improve, however, inkjet prints are disadvantaged because they lack durability, often being less stable relative to environmental factors (light, ozone, etc.) and more sensitive to water and abrasion.

One way of overcoming these disadvantages is to laminate or encapsulated inkjet prints. When an inkjet print is laminated, a transparent overlay is adhered to the inkjet print. Typically, this is accomplished using an adhesive activated by heat, pressure, or both. The transparent overlay physically protects the print and seals it from ingress of water. When an inkjet print is encapsulated, the print is positioned between two laminating sheets, at least one of which is transparent. Then some combination of the print and the laminating sheets are adhered usually using an adhesive activated by heat, pressure, or both. Typically, encapsulation is most effective when the laminating sheets extend beyond the print and are bonded to each other at the extremities, thus preventing ingress of water through exposed edges of the print.

Lamination and encapsulation both have disadvantages in that they are expensive processes requiring additional materials and handling by the user. Moreover, inkjet inks remained trapped within the recording element which can degrade image quality by causing stain or migration of the print on storage or exposure. Laminate materials and adhesives can often deteriorate over time causing surface defects including, for example, cracking. Laminates do not always adhere well to inkjet prints. The quality and uniformity of adhesion can depend on the material nature of the recording element, the type of ink, and the volume of ink printed per unit area of recording element (ink laydown). The latter is particularly significant when the inkjet print has photographic image quality because heavy laydowns of ink are necessary to achieve the necessary superb image quality.

As an alternative to lamination or encapsulation, inkjet recording elements having a nascent protective layer coated on a support are known. The nascent protective layer is really a special chemical layer designed such that during the inkjet printing process, the inks penetrate the layer, and after printing is complete, the layer is fused using heat and/or pressure so that it seals and protects the print. This process is often referred to as the incorporated approach because the nascent protective material is incorporated into the recording element during its production.

However, the incorporated approach is limited because it is difficult to obtain a final protected print that is uniform in gloss and clarity and free of surface defects such as blistering and cracking. Limitations are especially apparent when the final protected print must have superb image quality, e.g., when it is for photographic or medical diagnostic applications. A recording element for these applications may have one or more of these layer underlying the nascent protective layer to help manage a heavy laydown of ink. After printing, the bulk of the ink, commonly referred to as the carrier, is retained somewhere in the dual layer system. If too much carrier resides in the nascent protective layer during fusing, it will not fuse properly and any of the aforementioned undesirable effects may be observed.

This condition worsens when the carrier resides predominately in an ink-receiving layer during and/or after fusing of the nascent protective layer, and then migrates within the ink-receiving layer, or from the ink-receiving layer and into the fused protective layer. Migration of the carrier within the ink-receiving layer causes deterioration of image quality, e.g., loss of image sharpness and blotchiness, and migration into the fused protective layer causes any of the aforementioned undesirable effects.

An example of an inkjet printing method that employs the incorporated approach is the Canon HyperPhoto System described in U.S. Pat. No. 6,114,020, issued to Misuda et al., on Sep. 5, 2000; U.S. Pat. No. 4,832,984, issued to Hasegawa et al., on May 23, 1989; and U.S. Pat. No. 4,785,313, issued to Higuma et al., on Nov. 15, 1988.

European Patent Application 1 284 186 A2 describes a fixing apparatus and an image fixing method for improving the gloss of an inkjet image recorded on an inkjet recording material. The inkjet recording material includes a porous top layer which can be thermally fixed. After the image has been printed, the recording material is held in "a suspended state" before it is passed between a pair of fixing belts or rollers that are held at some elevated temperature and pressure.

Japanese Unexamined Patent Publication 2002-283553 A describes an inkjet recording device for controlling the gloss and clarity of an image surface of a recording medium. The device includes inkjet printing means for generating a printed image on a recording medium and fixing means for heating and pressing the printed image. The recording medium has a thermoplastic resin layer that receives ink and is subsequently fixed.

U.S. Pat. No. 6,394,669 B1, issued to Janosky et al., on May 28, 2002, discloses a post-print treatment processor for a photofinishing apparatus. Printed media is transported to a post-treatment processor. The post-treatment processor stations dry the media and apply a durable material on the printed media. In preferred embodiments, drying is accomplished using infrared radiation technology and application of the durable material is accomplished by laminating a clear protective film to the imaged side of the printed media.

U.S. Patent Application Publication 2002/0027587 A1 describes an apparatus and method for forming prints. A recording medium having thermoplastic resin particles on a surface layer is printed. Subsequently the resin particles are made transparent by a heating and pressing device. U.S. Patent Application Publication 2002/0008747 A1 describes a similar method.

U.S. Pat. No. 6,357,871 B1 describes an inkjet recording medium and apparatus for preparing an inkjet printed product. The inkjet recording medium has a layer of fine particles of a thermoplastic organic polymer that are dissolved or melted after inkjet recording to form a layer wherein the particles are fused to one another. Fusing the particles involves a step of heating the layer followed by an impressing step of passing the recording medium between a pair of press rolls while the layer is still in a plastic state after the heating step.

All of the aforementioned art are disadvantaged in that the bulk of the ink, or carrier, is trapped within the recording element after the protective layer is formed which leads to the problems described above.

U.S. Pat. No. 6,332,679 B1 describes an inkjet printer used to form an image on a recording medium. The recording medium includes a porous surface layer that is flattened by simultaneously pressing and heating the layer to form a flattened layer. Pressing is carried out by passing the imaged recording medium through a nip created by a pair of rollers. The nip is defined as a nip region having a point A at which the ink solvent contained in the recording medium reaches the boiling point, and a point B at which the porous layer of the recording medium loses its liquid permeation property.

The disadvantage associated with this method and apparatus is that ink solvent removal and flattening of the layer are carried out in the same step with very little physical distance between point A and point B. Therefore, neither step can be individually optimized and/or controlled. As a result, the flexibility of the method and apparatus to accommodate a broad range of recording media and ink volume laydowns is limited to those combinations that meet the temperature, pressure and transport speed conditions of the nip region. Another problem with this method and apparatus is that in order to remove enough ink solvent the temperature of the flattening roller must be high enough in order to cause sufficient evaporation before the liquid permeation property is eliminated. If the temperature is too high, the support can deform and release of the recording medium from the flattening roller becomes problematic. Additionally, the evaporated ink solvent can condense on the flattening roller making it difficult to maintain the temperature of the flattening roller. The condensed solvent can also redeposit on the surface or the recording medium increasing the potential for image defects.

U.S. Pat. No. 6,120,199 describes an inkjet printing apparatus having a heating fixation unit and a fixing unit. The heating fixation unit includes a fan that blows heated air over the surface of an imaged recording medium in an attempt to dry the surface before it enters the fixing unit. While ink solvent is allowed to escape from the imaged recording medium, the amount of ink solvent removed cannot be adequately controlled. Therefore, the reliability of the apparatus is reduced.

There is a need for an apparatus and method that removes a predetermined amount of carrier from an imaged and/or printed recording element, and subsequently increases a durability characteristic of the imaged and/or printed recording element while optimizing and/or controlling the conditions for each depending on the requirements of the imaged and/or printed recording element being treated.

SUMMARY OF THE INVENTION

According to one feature of the invention, an apparatus for treating a recording element includes a carrier removal station adapted to remove a predetermined percentage of carrier present in the recording element. A converting station is positioned downstream from the carrier removal station and is adapted to increase a durability characteristic of the recording element.

According to another feature of the invention, a method of treating a recording element includes removing a predetermined percentage of carrier present in the recording element in a first station; and increasing a durability characteristic of the recording element in a second station, wherein the second station is distinct from the first station.

BRIEF DESCRIPTION OF THE DRAWINGS

In the detailed description of the preferred embodiments of the invention presented below, reference is made to the accompanying drawings, in which.

DETAILED DESCRIPTION OF THE INVENTION

The present description will be directed in particular to elements forming part of, or cooperating more directly with, apparatus in accordance with the present invention. It is to be understood that elements not specifically shown or described may take various forms well known to those skilled in the art.

Referring to FIGS. 1–9, example embodiments of the invention are shown with like components being described using like reference symbols. Although the embodiments of the invention are suited for obtaining monochrome or multicolored transparent prints typically used in medical diagnostic imaging applications, the embodiments of the inventions also find application in other areas, for example, in obtaining monochrome or multicolor reflective prints suitable for use in medical diagnostic imaging applications, photographic applications, etc.

Figure 1:
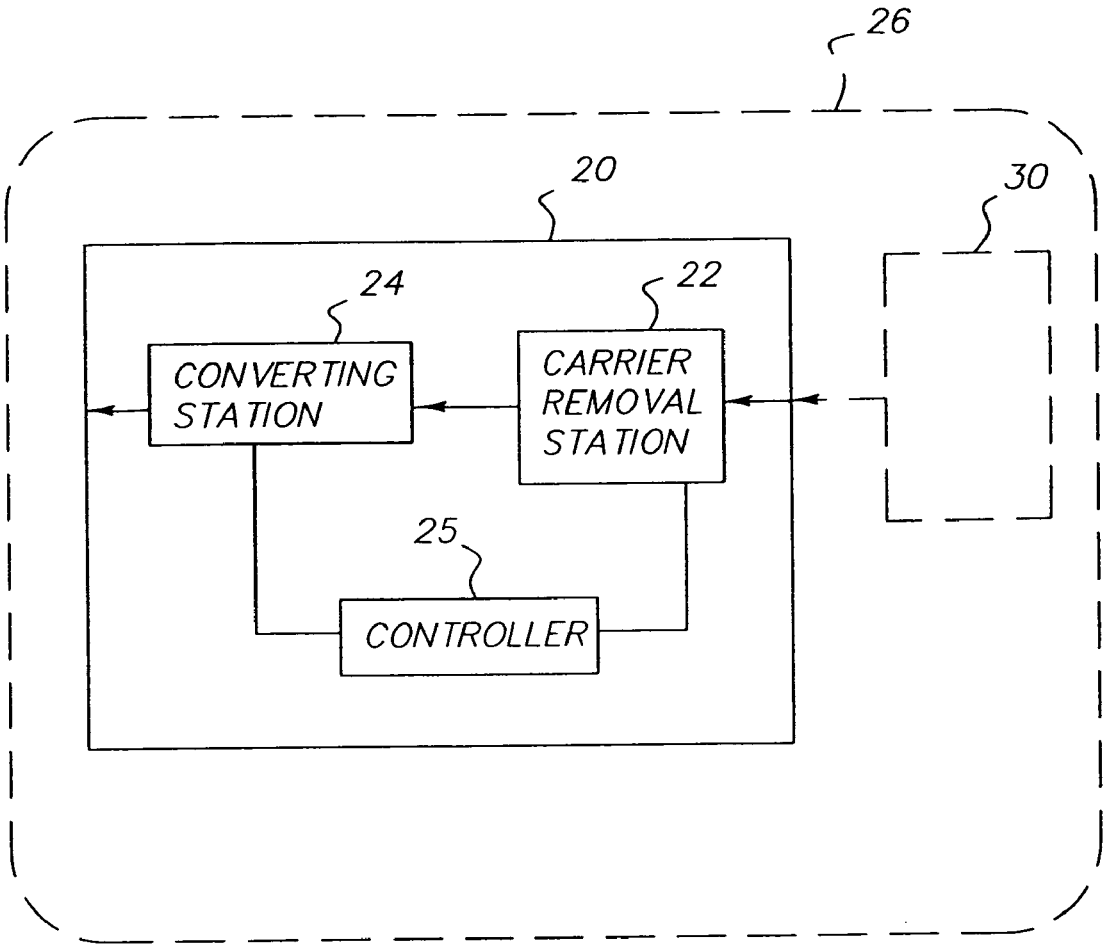
FIG. 1 is a block diagram of an apparatus made in accordance with the invention.

Referring to FIG. 1, a block diagram of a recording element treating apparatus 20 is shown. Apparatus 20 includes two stations—a carrier removal station 22 which removes carrier, typically an ink carrier, from a recording element and a converting station 24 which increases, or improves, a durability characteristic of the recording element. Carrier removal station 22 and converting station 24 are connected to a conventional controller 25 which allows either and/or both stations 22 and 24 to be individually controlled, programmed, and/or adjusted depending on one or more factors. These factors include, for example, media type, ink type, desired image resolution, etc. Controller 25 can include a user interface, as is known in the art, or can be of the type that adjusts operating parameters automatically based on, for example, information received from other components of the apparatus 20 and/or printing system 26 (discussed below).

As used herein, durability characteristic refers to any characteristic related to the preservation of an imaged recording element, or inkjet print. For example, durability characteristic refers to the stability of an inkjet print towards environmental factors such as light and ozone which can cause discoloration or fading of the imaged recording element. Other examples of durability characteristics include the stability or resistance of an inkjet print towards humidity, water, staining, and physical abrasion.

Apparatus 20 can be incorporated into a conventional printing system 26. In this context, conventional printing systems include any printing system that deposits one or more inks onto and/or into a recording element, for example, an inkjet printing system, etc. The embodiments discussed below are done so in the context of an inkjet printing system 26. However, any type of printing system 26 that deposits a liquid, for example, a colorant having a carrier can be used with apparatus 20. When incorporated into printing system 26, controller 25 can also be incorporated into system 26 and/or included in addition to any printing system controllers.

Typically, an inkjet printing system 26 includes one or more printheads, recording element conveying systems, controllers, user interfaces, etc. (shown generally using 30). Inkjet printing system 26 can include a drop-on-demand type printer employing a piezoelectric printhead or a thermal printhead. Alternatively, system 26 can include a continuous type printer. Ink drop formation can be accomplished using any conventional technique.

Any conventional inkjet ink can be deposited on and/or in the recording element using inkjet printing system 26. Typical inkjet inks are either aqueous-based or solvent-based and include mostly carrier and a small amount of pigment and/or dye colorant. For aqueous-based inks, water and water-miscible humectants and co-solvents such as polyhydric alcohols such as diethylene glycol or glycerol are the carrier. Solvent-based inks contain one or more organic solvents as the carrier; for example, alcohols such as methanol, ethanol, propanol, iso-propanol; ketones such as acetone, methyl ethyl ketone, methyl isobutyl ketone, cyclohexanone and 4-methoxy-4-methylpentanone; hydrocarbons such as cyclohexane, methylcyclohexane, n-pentane, n-hexane and n-heptane; esters such as ethyl acetate and n-propyl acetate; dimethyl sulfoxide; n-methyl-2-pyrrolidone; γ-butyrolactone; toluene; xylene and high-boiling petroleums. The choice of carrier is not particularly limited, as long as it can be removed by the carrier removal station 22 without causing deformation or deterioration of the recording element or the image printed thereon.

In one embodiment, aqueous-based inks are used with the invention to generate inkjet prints. Examples of aqueous-based inkjet inks include any inkjet ink commercially available from, for example, Canon, U.S.A., Inc.; Epson America, Inc.; Hewlett-Packard Co.; Eastman Kodak Co.; etc.

Pigment or dye colorant components of inks used with inkjet printing system 26 have either chromatic color such as cyan, magenta, yellow, orange, green, or violet, or they can have achromatic color such as black, white, gray or colorless. In certain imaging applications, inks having the same hue but different densities are employed. For example, an inkjet printer designed for rendering medical images typically employs a set of black inks, wherein each ink in the set has the same hue but a different density in order to generate high-quality multilevel grayscale images.

Pigment colorants useful in the inks that can be employed in inkjet printing system 26 include any known pigment, or combination of pigments, commonly used in the art of inkjet printing. Such pigments include azo pigments, naphthol pigments, benzimidazolone pigments, metal complex pigments, phthalocyanine pigments, quinacridone pigments, perylene and perinone pigments, anthrapyrimidone pigments, flavanthrone pigments, anthanthrone pigments, dioxazine pigments, titanium oxide, iron oxide, carbon black and the like. Preferred pigments are C.I. Pigment Blue 15:3; the bridged aluminum phthalocyanine pigment described in U.S. Pat. No. 5,738,716; C.I. Pigment Red 122; C.I. Pigment Yellow 155; C.I. Pigment Yellow 74; C.I Pigment Yellow 97; C.I Pigment Yellow 128 or C.I. Pigment Black 7, because combinations of these pigments tend to provide the best color. The exact choice of pigment will depend upon the specific application and performance requirements such as color reproduction and image stability.

Pigment colorants useful in the inks that can be employed in inkjet printing system 26 generally have average particle sizes of less than about 500 nm. Preferably, the average particle size is less than 200 nm, and especially less than 90 nm, because inks formulated with pigments having these particle sizes tend to jet reliably. For aqueous-based inks containing pigment colorants, a dispersant is typically used to stabilize the pigment particles against flocculation and settling. Dispersants are typically used to mill the pigment particles to an appropriate size, as described, for example, in U.S. Pat. Nos. 5,679,138; 5,085,698 and 5,172,133 and are added to the ink as part of the pigment itself. Dispersants may also be added separately from the pigment. Self-dispersing pigments may also be used; these types of pigments are inherently stable against flocculation and settling and do not require a dispersant.

Dye colorants useful in the inks that can be employed in inkjet printing system 26 include any known dye, or combination of dyes, commonly used in the art of inkjet printing. Such dyes include water-soluble reactive dyes, direct dyes, anionic dyes, cationic dyes, acid dyes, food dyes, metal-complex dyes, phthalocyanine dyes, anthraquinone dyes, anthrapyridone dyes, azo dyes, rhodamine dyes, and the like. Typical examples of dyes include C.I. Direct Yellow 86, 107, 132, 173; Acid Yellow 17 and 23; C.I. Reactive Red 23, 24, 31, 120, 180, 241; Acid Red 35, 52, 249, 289, 388; Direct Red 227; CAS No. 224628-70-0 sold as JPD Magenta EK-1 Liquid from Nippon Kayaku Kabushiki Kaisha; CAS No. 153204-88-7 sold as Intrajet® Magenta KRP from Crompton and Knowles Colors; the metal azo dyes disclosed in U.S. Pat. Nos. 5,997,622 and 6,001,161; C.I. Direct Blue 86, 199, 307; Acid Blue 9; Reactive Black 31; Direct Black 19, 154, 168; Food Black 2; Fast Black 2, Solubilized Sulfur Black 1 (Duasyn® Black SU-SF). The exact choice of dye will depend upon the specific application and performance requirements such as color reproduction and image stability.

Humectants, co-solvents, surfactants, defoamers, buffering agents, chelating agents, and conductivity-enhancing agents are usually employed in inkjet inks for a variety of reasons, most of which are dictated by the requirements of the printhead from which they are printed. Thermal and piezoelectric drop-on-demand printheads and continuous printheads each require inks with a different set of physical properties in order to achieve reliable and accurate jetting of the ink, as is well known in the art of inkjet printing. Humectants, co-solvents and surfactants are also used to prevent the inks from drying out or crusting in the orifices of the printhead, aid solubility of the components in the ink, and facilitate penetration of the ink into the recording medium after printing. A typical aqueous-based ink useful in the inkjet printing system 26 may contain, for example, the following components based on the total weight of the ink: colorant 0.05–10%, water 20–95%, humectant(s) 5–70%, co-solvent(s) 2–20%, surfactant(s) 0.02–10%, and biocide(s) 0.05–5%, and have a pH of 2–10.

Although the inks described above are conventional inkjet inks, any fluid that can be jetted using an inkjet printer can be used in inkjet printing system 26, as long as the fluid includes a carrier that can be removed by the carrier removal station without causing deformation or deterioration of the recording element itself or the image printed thereon. Other examples of fluids that can be used in inkjet printing system 26 include radiation-curable inks, and colorless inks containing fragrance agents, flavoring agents, or compounds that are used to provide security features such as near-infrared fluorescent compounds, UV-absorbing compounds, and the like.

Any recording element can be used with apparatus 20 provided the recording element is capable of absorbing ink and undergoing a durability characteristic change or alteration. Again, durability characteristics include, but are not limited to, resistance to water, stains, light, ozone, scratches, rubbing, etc. The recording element typically includes a support having at least one ink-receiving layer coated thereon. For recording elements consisting of a single ink-receiving layer coated on a support, the layer should be of the type that initially allows absorption of the ink, and then permits at least some of carrier (for example, some of the water) to be removed from it, and at least a portion of the layer should be of the type that a durability characteristic of the recording element can be increased.

It will be recognized that the durability characteristic of the recording element is inherent, i.e. intrinsic, rather than one that is added after manufacture of the recording element. See the description of the preparation of the recording element which follows under the heading "Experimental Results".

Recording elements that can be used with apparatus 20 may also consist of a plurality of ink-receiving layers wherein the layers provide the same or different functions. For example, one layer may be used to trap dye or pigment colorant, and another layer may be used to trap any of the other ink components including carrier. The layers may be in any order on the support, as long as the uppermost layer (the layer that first receives ink) is of the type that a durability characteristic of the recording element as a whole is capable of being increased. Durability characteristics of the other layers may also be changed, preferably increased, as long as the uppermost layer can be converted to increase a durability characteristic of the recording element as a whole. The layers should be optimized relative to one another such that the recording element as a whole initially allows absorption of the ink, and then permits at least some of the carrier to be removed from at least one of the layers and from the recording element as a whole.

In one embodiment of the invention, the recording element has a single layer coated on a porous support such that the colorant is trapped in the single layer before and after a durability characteristic of the layer has been increased, and such that any remaining carrier including humectants, co-solvents and water can evaporate from the recording element through the porous support over time after a durability characteristic has been increased.

In another embodiment of the invention, the recording element has two layers, an uppermost layer coated on an underlying layer that is coated directly on a nonporous or porous support. The uppermost layer traps the colorant and both layers absorb the remainder of the ink. Both layers function together such that carrier removal station 22 removes a predetermined amount of carrier from the recording element as a whole, and before a durability characteristic of the recording element is increased, any remaining carrier is trapped in the underlying layer. One or both of the layers, preferably at least the uppermost layer, are converted by converting station 24 such that a durability characteristic of the recording element as a whole is increased.

Examples of suitable recording elements include those described in U.S. Pat. No. 6,497,480 B1 issued to Wexler on Dec. 24, 2002; U.S. Pat. No. 6,475,603 B1 issued to Wexler on Nov. 5, 2002; and U.S. Pat. No. 6,399,156 B1 issued to Wexler et al. on Jun. 4, 2002; and U.S. application Ser. No. 10/289,862 of Yau et al. filed Nov. 7, 2002; Ser. Nos. 10/260,665 and 10/260,663 both of Wexler et al. filed Sep. 30, 2002; and U.S. application Ser. No. 10/011,427 of Yau et al. filed Dec. 4, 2001.

Additional examples of suitable recording elements include any recording element known in the industry as being fusible, or any recording element that utilizes the incorporated approach, as described above. Other suitable recording element examples include those described in U.S. Pat. No. 5,374,475, issued to Walchli, on Dec. 20, 1994; U.S. Pat. No. 6,357,871 B1, issued to Ashida et al., on Mar. 19, 2002; U.S. Patent Applications 2002/0008747 A1; 2002/0048655 A1; European Patent Application 1,078,775 A2; Japanese Unexamined Patent Publication No. 01-182081, in the name of Akitani et al.

The size of the recording element can be any size appropriate for its intended use. For example, the recording element can be used as labels or tape and have a width of less than 0.25 cm (0.1 in) and any length. Alternatively, the recording medium can be used as signage and have a width of over 183 cm (72 in). The recording element can be of the type used in the medical imaging industry and have dimensions of 35.6 cm by 43.2 cm (14 in by 17 in). Or, the recording element can have dimensions typically associated with photographic images of various sizes, for example, 8.89 cm×12.7 cm (3.5×5 inch format); 10.16 cm×15.24 cm (4×6 inch format); 20.32 cm×25.4 cm (8×10 inch format); etc.

Figure 2:
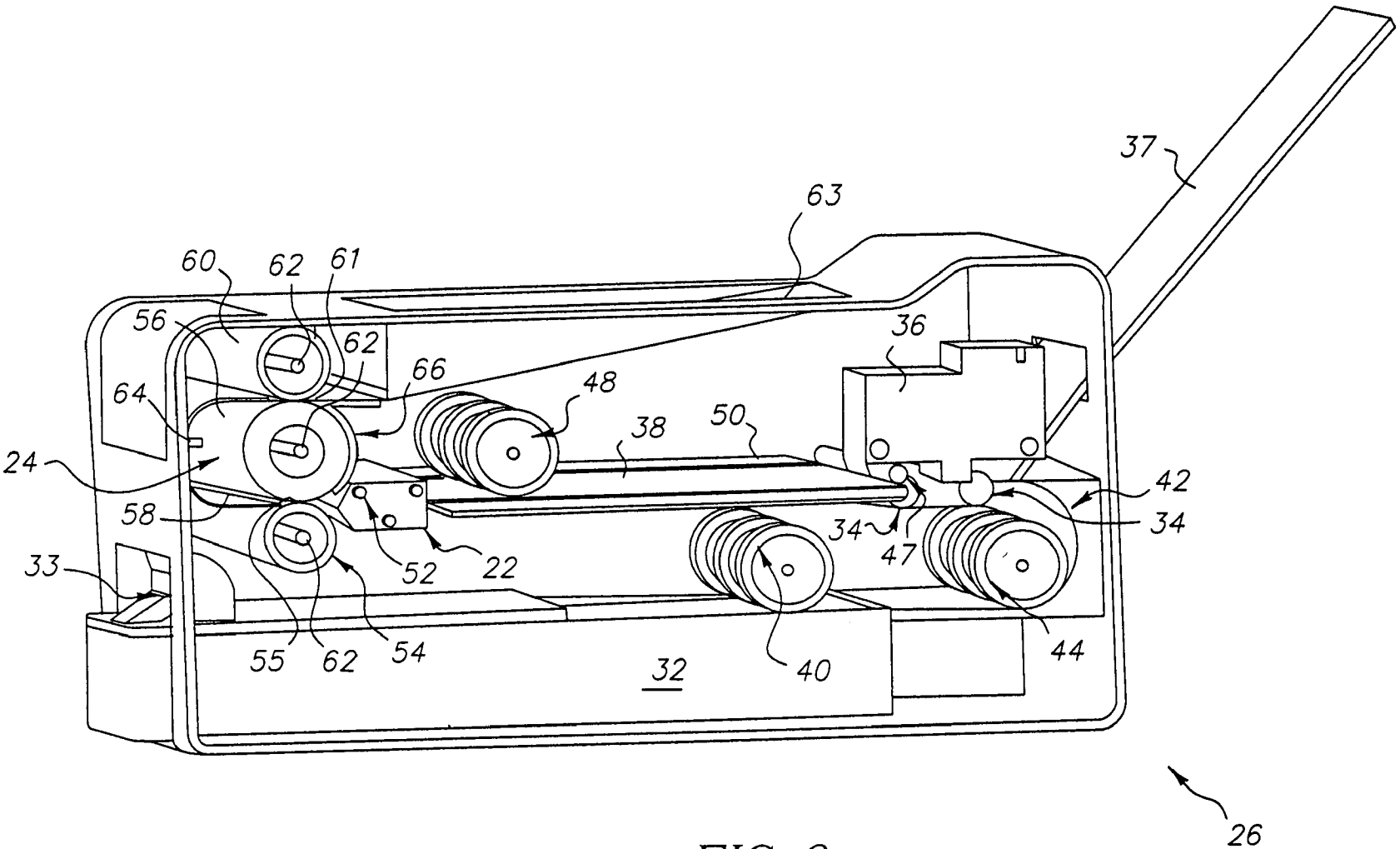
FIG. 2 is a schematic perspective view of an example embodiment of the invention.

Referring to FIG. 2, an example embodiment of recording element treating apparatus 20 is shown incorporated into inkjet printing system 26. Inkjet printing system 26 includes a removable recording element supply tray 32, a recording element conveying system (shown generally using 34), and a printhead 36. Supply tray 32 can be replenished with recording element 38 by removing supply tray 32 from printing system 26 using a handle 33, filling supply tray 32 with additional recording element 38, and reinserting supply tray 32 into printing system 26. Printing system 26 can also include an auxiliary recording element feed supply 37. In alternative embodiments, printing system 26 can include any number of components known in the industry.

During operation, recording element 38 is caused to move from supply tray 32 by recording element picking wheels 40 and caused to travel through a recording element supply chute 42 by recording element urging wheels 44. After exiting supply chute 42, an image and/or text is printed on recording element 38 by printhead 36 (included in a printing station). Conveying system 34 including one or more driven pinch wheels 47 moves recording element 38 through printing station 46. Intermediate transport wheels 48 move printed recording element 38 over a transport platform 50 toward treating apparatus 20.

Treating apparatus 20 includes a carrier removal station 22 which includes a device(s) 52 that removes carrier from recording element 38. In the embodiment shown in FIG. 2, device 52 includes one or more halogen lamps that produce heat that evaporates or removes carrier from recording element 38. Depending on temperature conditions inside carrier removal station 22, carrier removal station 22 can also preheat recording element 38 as recording element 38 moves toward converting station 24, using for example, device 52. Doing this can result in increased productivity (commonly referred to as thru-put) in apparatus 20.

Recording element 38 enters converting station 24 by passing through a transport roller 54 and a roller 56 which form a transporting nip 55. The relative positions of roller 54 and roller 56 are such that the pressure created and applied to recording element 38 by roller 54 and roller 56 is sufficient to move recording element 38 around an inverter chute 58 without significantly altering a durability characteristic of recording element 38. Inverter chute 58 also functions as a shield helping to maintain the operating temperature of the converting station 24.

Recording element 38 then passes through a pressure roller 60 and roller 56 which form a converting nip 61. The relative positions of roller 60 and roller 56 are such that the pressure created and applied to recording element 38 by roller 60 and roller 56 is sufficient to increase a durability characteristic of recording element 38 as recording element 38 travels through roller 60 and roller 56. Recording element 38 exits treating apparatus 20 coming to rest in an exit tray 63.

Depending on the desired application, roller 56 (and/or roller 60 and/or roller 54) can be hollow and include a heating element 62 (for example, a halogen lamp, etc.) that elevates the temperature of the converting station 24 and helps with the durability characteristic change. Typically, heating element 62 is located within roller 60 and/or roller 56. However, heating can also be included in roller 54 to preheat recording element 38 prior to recording element 38 reaching roller 60. Doing this decreases the temperature gradient between recording element 38 and roller 60 which can decrease the likelihood of image defects and can increase the speed at which rollers 54, 56, 60 are operated. A temperature sensor 64 (connected to a temperature control device located, for example, in controller 30 of printing system 26 or controller 25 of apparatus 20), can be included in the converting station 24 to monitor temperature inside the converting station 24. A shield 66 can also be positioned where needed to protect components of printing system 26 and/or treating apparatus 20 from excessive heat, etc. If desired, an additional heating element can be positioned within the cavity formed by roller 56 and shield 66 in order to preheat recording element 38 as described above.

Printing system 26, shown in FIG. 2, has a "S" shaped recording element 38 travel path where portions of the travel path overlap other portions of the travel path, either vertically (as shown in FIG. 2) or horizontally, as the travel path is followed from start to finish or vice versa. This facilitates a reduced printing system 26 footprint such that printing system 26 can be a "desktop" type printer or a mid-format type printer that can easily fit onto a desktop.

Although the embodiment shown in FIG. 2 has an "S" shaped travel path, it is recognized that other travel path configurations can facilitate a desktop type printing system 26. For example, in FIG. 3, another embodiment of apparatus 20 is shown which incorporates a travel path that is not curved in the region of apparatus 20.

Figure 3:
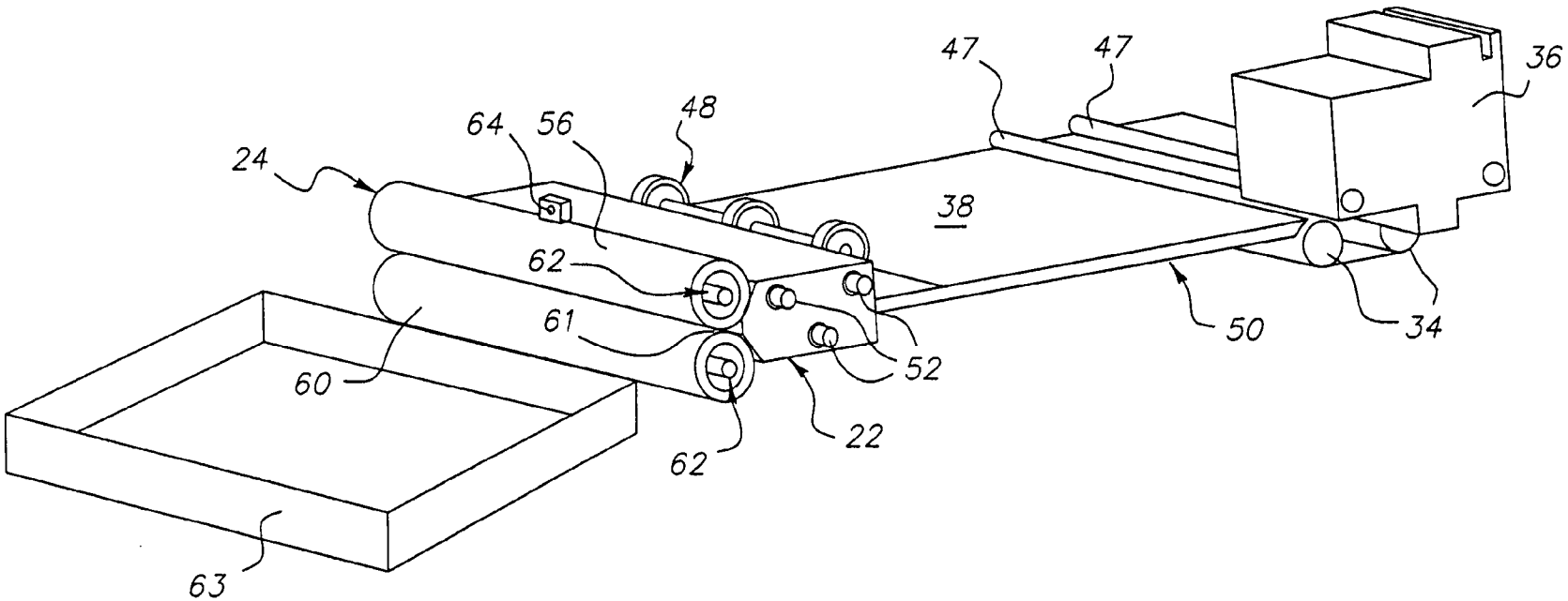
FIG. 3 is a schematic perspective view of another example embodiment of the invention.

Referring to FIG. 3, in this embodiment, recording element 38 travels through carrier removal station 22 which includes device(s) 52, for example, one or more halogen lamps, that removes carrier from recording element 38 as described above with reference to FIG. 2. In this embodiment, carrier removal station 22 also preheats recording element 38 as recording element 38 moves toward converting station 24 using device 52. This prepares recording element 38 for entry into converting station 24 by decreasing the temperature gradient between recording element 38 and roller 60 and/or roller 56 which can decrease the likelihood of image defects and can increase the speed at which rollers 56 and 60 are operated. This increases productivity (thru-put) in apparatus 20. When carrier removal station 22 is operated in this fashion, the preheating portion of the converting station 24 is, often, not necessary. However, inclusion of the preheating portion of converting station 24 can depend on the desired converting temperature range(s).

Recording element 38 enters converting station 24 by passing through pressure roller 60 and roller 56 which form converting nip 61. Again, the relative positions of roller 60 and roller 56 are such that the pressure created and applied to recording element 38 by roller 60 and roller 56 is sufficient to alter a durability characteristic of recording element 38 as recording element 38 travels through roller 60 and roller 56. Recording element 38 exits treating apparatus 20 coming to rest in exit tray 63.

Roller 56 and/or roller 60 can also be hollow and include heating element 62 (for example, a halogen lamp, etc.) that elevates the temperature of the converting station 24 and assists with the durability characteristic change. Temperature sensor 64 (connected to a temperature control device located, for example, in controller 30 of printing system 26 or controller 25 of apparatus 20), can be included in the converting station 24 to monitor temperature inside the converting station 24.

Figure 4:
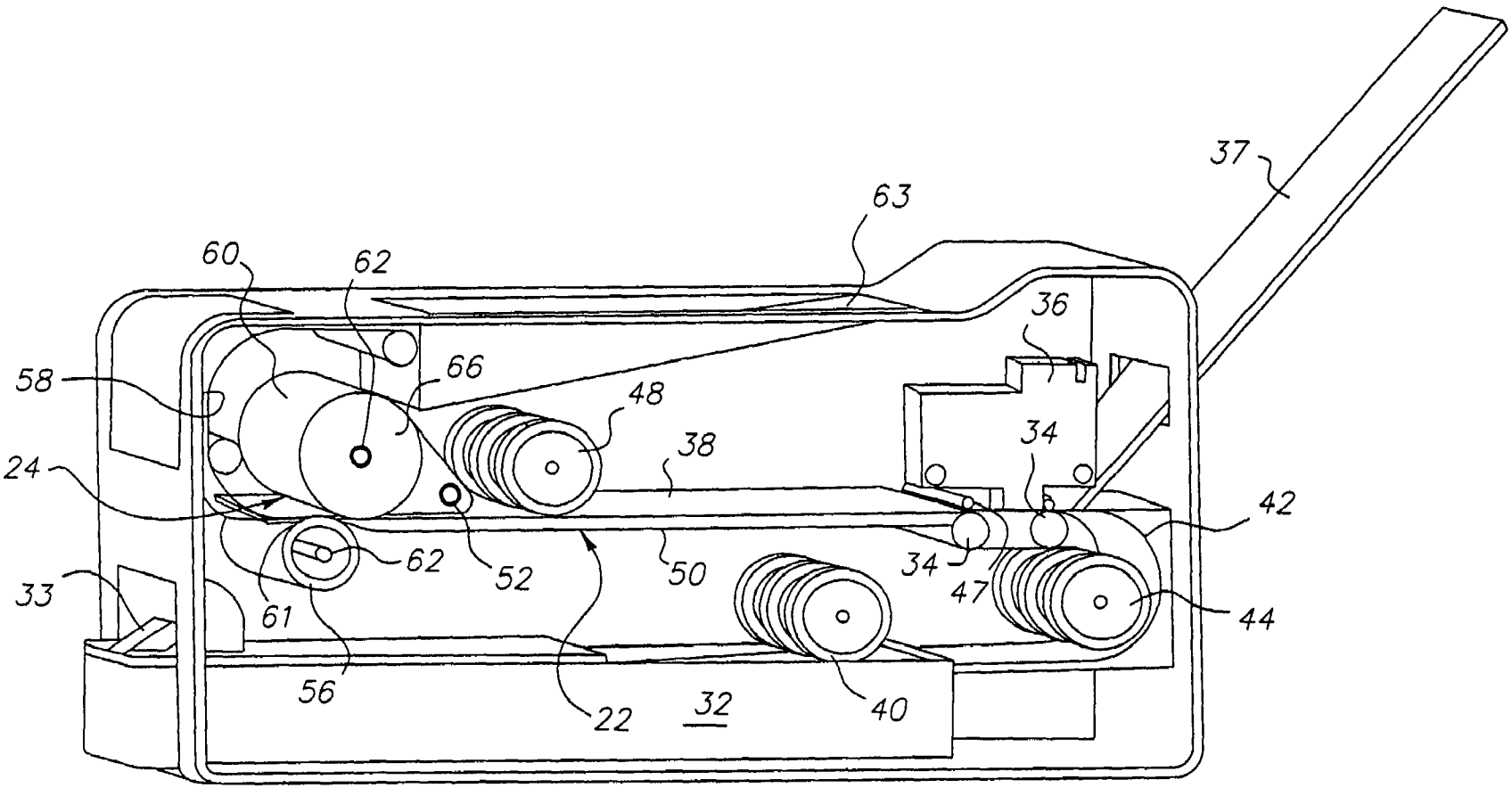
FIG. 4 is a schematic perspective view of another example embodiment of the invention.

Referring to FIG. 4, another embodiment of apparatus 20 is shown. Here, apparatus 20 is similar to apparatus 20 as shown in FIG. 3. However, the recording element travel path by means of the conveying system 34 exiting apparatus 20 is curved and the overall travel path from start to finish includes overlapping portions like those described previously.

In this embodiment, recording element 38 travels through carrier removal station 22 which includes device(s) 52, for example, one or more halogen lamps, that removes carrier from recording element 38 as described above with reference to FIG. 2. In this embodiment, carrier removal station 22 also preheats recording element 38 as recording element 38 moves toward converting station 24, using for example, device 52. This prepares recording element 38 for entry into converting station 24 by decreasing the temperature gradient between recording element 38 and roller 60 and/or roller 56 which can decrease the likelihood of image defects and can increase the speed at which rollers 56 and 60 are operated. This increases productivity (thru-put) in apparatus 20. When carrier removal station 22 is operated in this fashion, the preheating portion of the converting station 24 is, often, not necessary. However, the inclusion of the preheating portion of converting station 24 can also depends on the desired converting temperature ranges.

Recording element 38 enters converting station 24 by passing through pressure roller 60 and roller 56 which form converting nip 61. Again, the relative positions of roller 60 and roller 56 are such that the pressure created and applied to recording element 38 by roller 60 and roller 56 is sufficient to alter a durability characteristic of recording element 38 as recording element 38 travels through roller 60 and roller 56. Recording element 38 exits treating apparatus 20 coming to rest in exit tray 63. Shield 66 can also be positioned where needed to protect components of printing system 26 and/or treating apparatus 20 from excessive heat, etc.

Again, depending on the contemplated application, roller 56 and/or roller 60 are hollow and include heating element 62 (for example, a halogen lamp, etc.) that elevates the temperature of the converting station 24 and assists with the durability characteristic change. A temperature sensor, for example, temperature sensor 64, (connected to a temperature control device located, for example, in a controller of printing system 26), can be included in the converting station 24 to monitor temperature inside the converting station 24.

Figure 5:
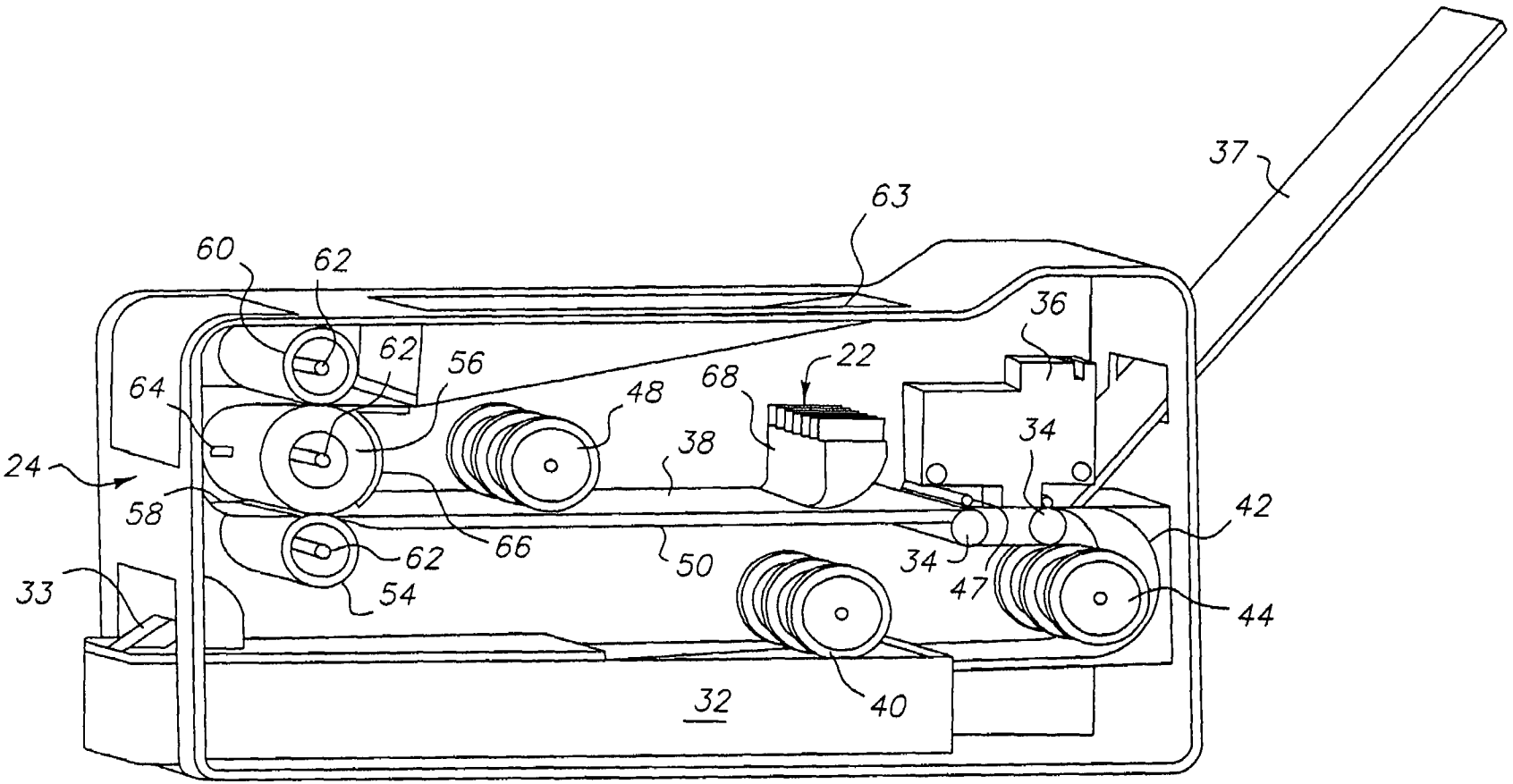
FIG. 5 is a schematic perspective view of another example embodiment of the invention.

Referring to FIG. 5, carrier removal station 22 is positioned spaced apart from converting station 24, to illustrate that variations in the relative positions of the carrier removal station 22 and the converting station 24 are possible, and depending on the application and operating environment quite probable. Here, carrier removal station 22 includes device 68, for example, a forced air convection element one that directs a gas flow (for example, air at ambient temperature, heated air, etc.) over recording element 38 as recording element 38 travels through carrier removal station 22. This process evaporates at least some carrier present in recording element 38 prior to recording element 38 entering converting station 24.

In this embodiment, device 68 can also be used to preheat recording element 38 by blowing heated air over recording element 38. Typically, carrier removal station 22 or at least the preheating portion of carrier removal station 22 is positioned closer to converting station 24 when preheating is desired, however, specific applications may require that carrier removal station 22 or the preheating portion of carrier removal station 22 be positioned spaced apart from converting station 24.

In the embodiment shown in FIG. 5, converting station 24 is like the converting station 24 described with respect to FIG. 2. However, depending on the contemplated application, converting station 24 can be of the type described with reference to FIGS. 3 and/or 4.

Figure 6:
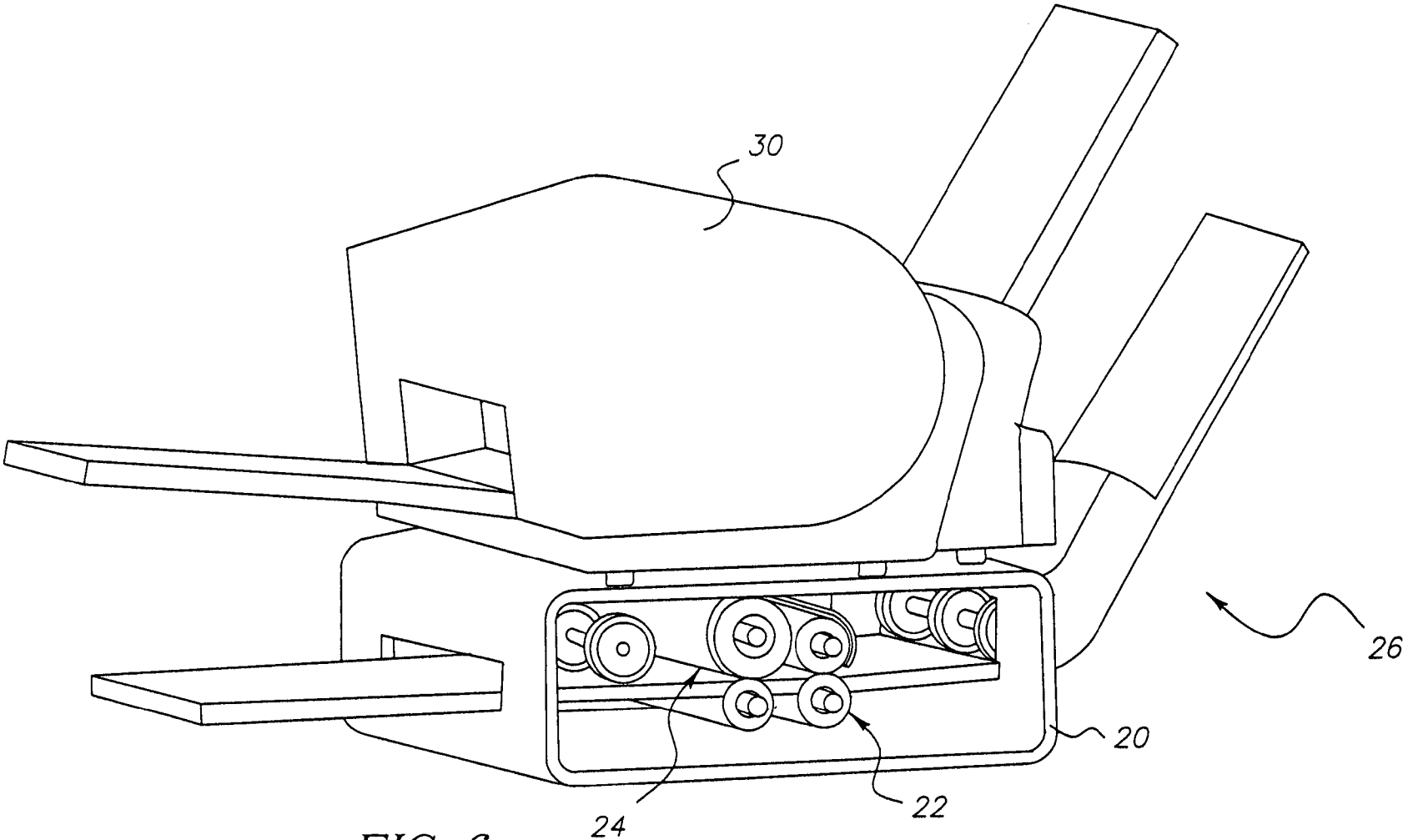
FIG. 6 is a schematic perspective view of another example embodiment of the invention with a printer.

Referring to FIG. 6, another embodiment of apparatus 20 is shown. Here, apparatus 20 is not incorporated into printing system 26. Rather, apparatus 20 is what is commonly referred to as a "stand alone" type device. Typically, this configuration of apparatus 20 is used with a "stand alone" type printing system 26. As shown in FIG. 6, printing system 26 can be placed on a top surface 70, shown in FIG. 7, of apparatus 20. Alternatively, apparatus 20 can be placed adjacent to or spaced apart from printing system 26. The footprint of apparatus 20 can be such that apparatus 20 is considered a desktop type device.

Figure 7:
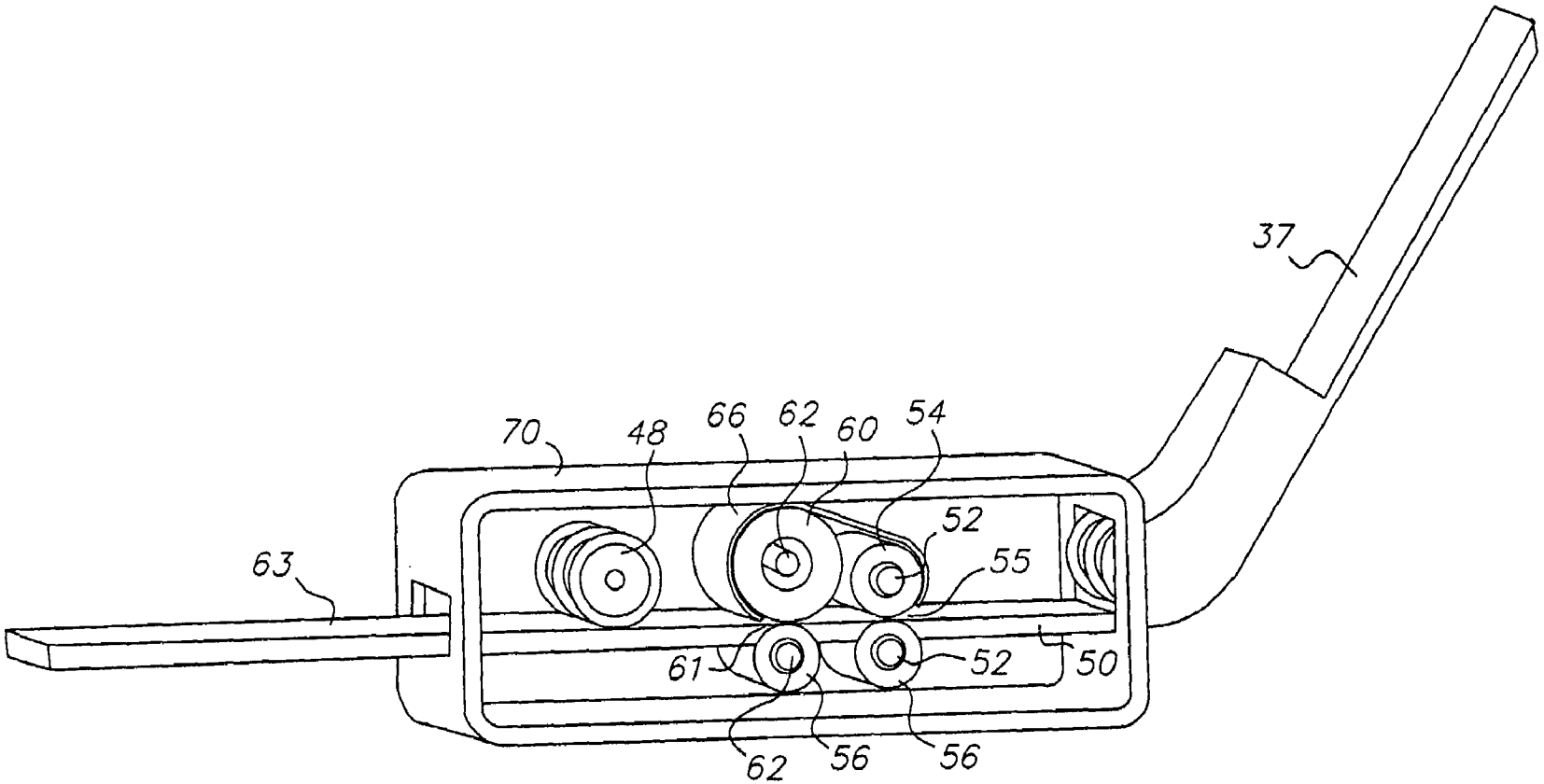
FIG. 7 is a schematic perspective view of the example embodiment shown in FIG. 6 without the printer.

Referring to FIG. 7, operation of apparatus 20 is described. A printed recording element 38 is fed, typically, image side facing upward (although apparatus 20 can be configured such that the image side can be facing downward) into apparatus 20 using feed supply 37 and travels to carrier removal station 22. Typically, recording element 38 is fed into apparatus 20 by a system user. However, it is contemplated that apparatus 20 can be connected to printing system 26 using a conventional media handling or conveyance system, for example, a conveyor belt mechanism. In this configuration, feed supply 37 and the output tray of printing system 26 can be removed and replaced by the media handling or conveyance system.

Carrier removal station 22 includes transport roller 54 and a roller 56 which form a transporting nip 55. The relative positions of roller 54 and roller 56 are such that the pressure created and applied to recording element 38 by roller 54 and roller 56 is sufficient to move recording element 38 through carrier removal station 22 without significantly altering a durability characteristic of recording element 38. Carrier removal is accomplished by including one or more devices 52 that remove carrier from recording element 38. For example, device 52 can include one or more halogen lamps that produce heat which evaporates or removes carrier from recording element 38. Depending on temperature conditions inside carrier removal station 22, carrier removal station 22 can also preheat recording element 38 as recording element 38 moves toward converting station 24, using for example, heating element 62. Doing this can result in increased productivity (thru-put), for example, in apparatus 20.

Recording element 38 enters converting station 24 which includes a pressure roller 60 and a second roller 56 which form a converting nip 61. The relative positions of roller 60 and second roller 56 are such that the pressure created and applied to recording element 38 by roller 60 and second roller 56 is sufficient to alter a durability characteristic of recording element 38 as recording element 38 travels through roller 60 and second roller 56. Recording element 38 exits treating apparatus 20 coming to rest in exit tray 63.

As described above, roller 60 and/or roller 56 (and/or roller 54) can be hollow and include a heating element 62 (for example, a halogen lamp, etc.) that elevates the temperature of the converting station 24 and helps with the durability characteristic change. Typically, heating element 62 is located within roller 60 and/or roller 56. However, heating can also be included in roller 54 to preheat recording element 38, in addition to removing carrier, prior to recording element 38 reaching roller 60. Doing this decreases the temperature gradient between recording element 38 and roller 60 which can decrease the likelihood of image defects and can increase the speed at which rollers 54, 56, 60 are operated. A temperature sensor, for example, temperature sensor 64 shown in FIG. 2, (connected to a temperature control device located, for example, in controller 25 of apparatus 20), can be included in the converting station 24 to monitor temperature inside the converting station 24. A shield 66, as shown in FIG. 2, can also be positioned where needed to protect components of printing system 26 and/or treating apparatus 20 from excessive heat, etc.

Figure 8:
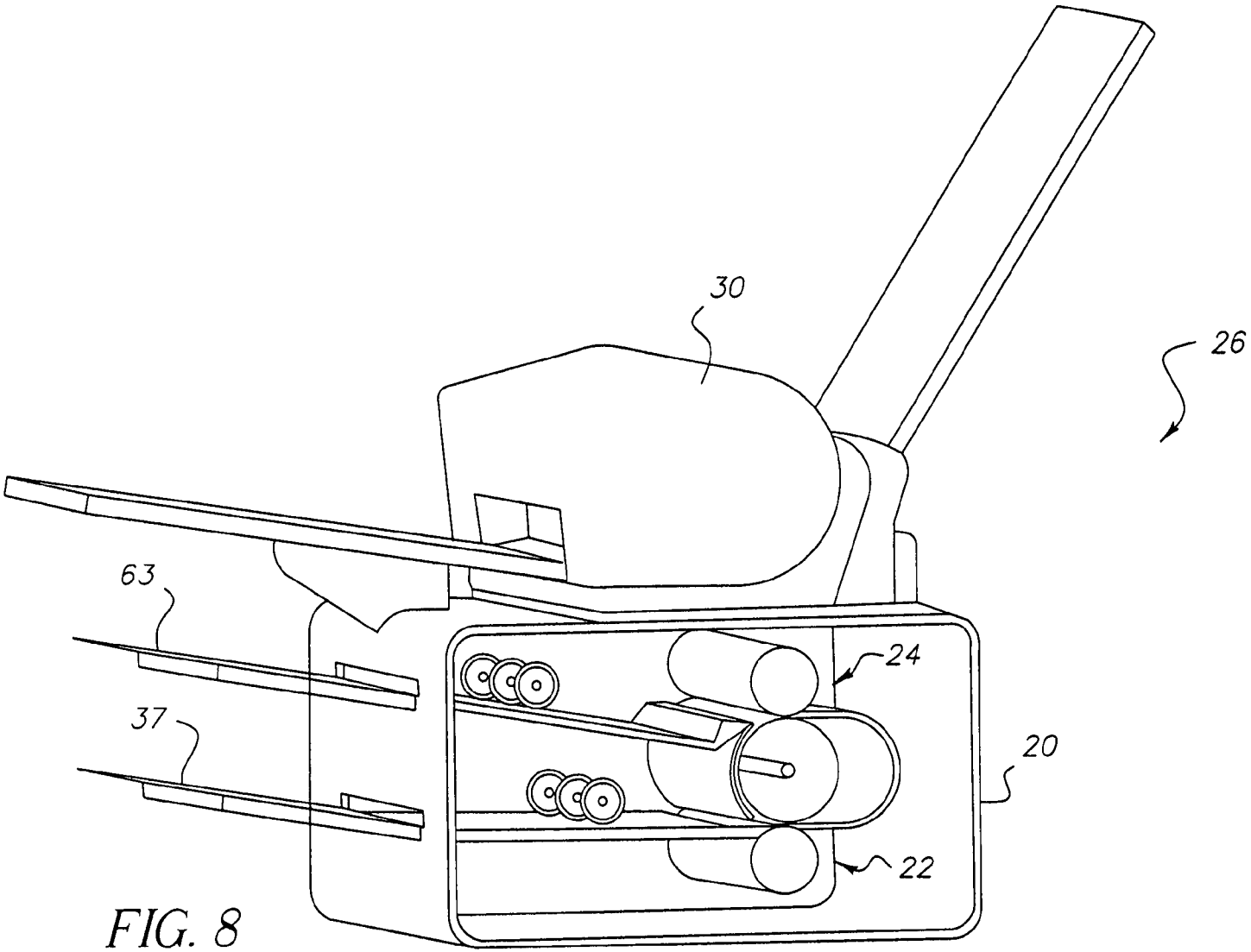
FIG. 8 is a schematic perspective view of another example embodiment of the invention with a printer.

Referring to FIG. 8, another embodiment of a "stand alone" apparatus 20 is shown. This configuration of apparatus 20 can be used with a "stand alone" type printing system 26. As shown in FIG. 8, printing system 26 can be placed on a top surface 70 of apparatus 20. Alternatively, apparatus 20 can be placed adjacent to or spaced apart from printing system 26. The footprint of apparatus 20 can be such that apparatus 20 is considered a desktop type device.

Figure 9:
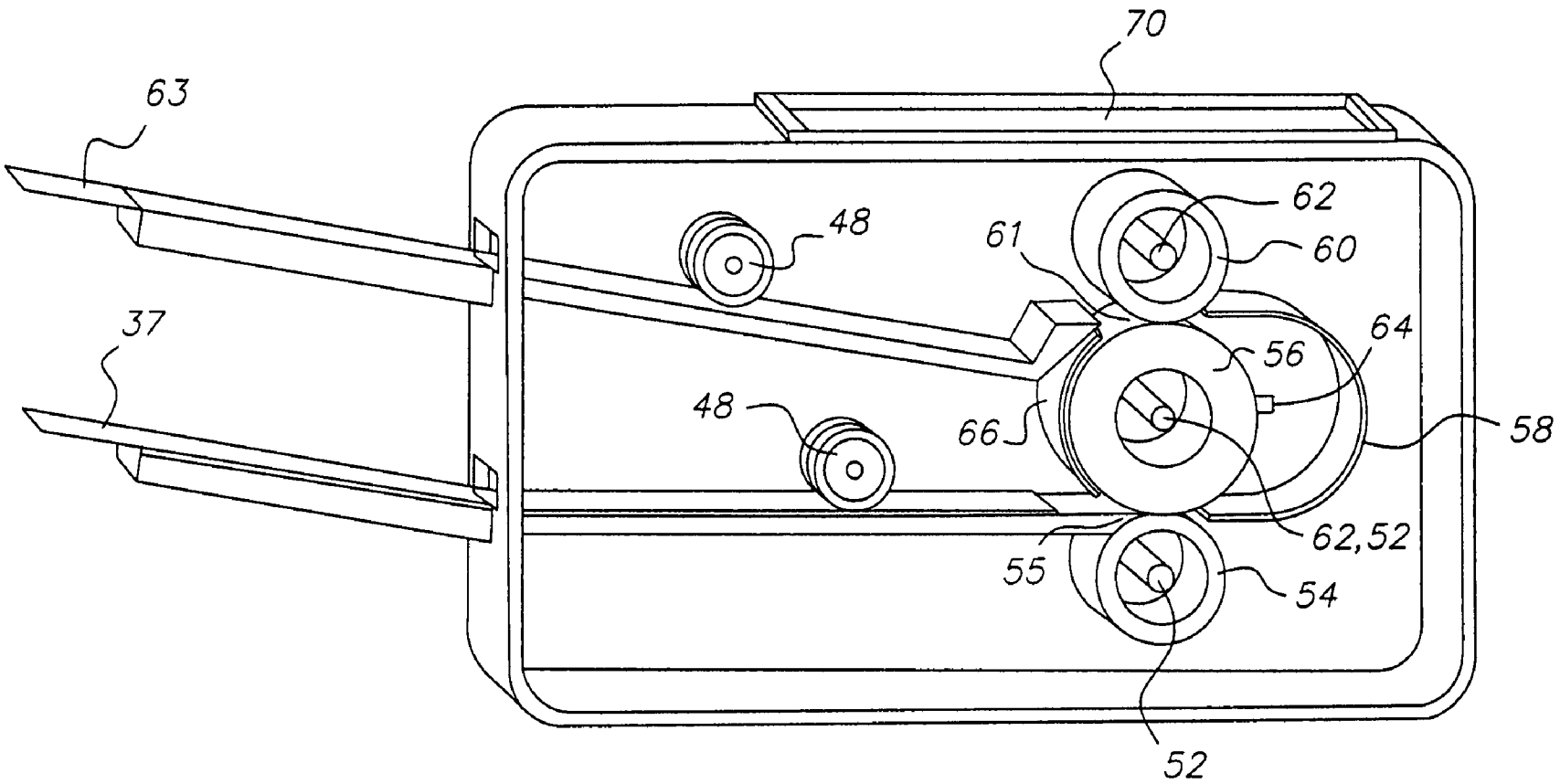
FIG. 9 is a schematic perspective view of the example embodiment shown in FIG. 8 without the printer.

Referring to FIG. 9, operation of apparatus 20 is described. A printed recording element 38 is feed into apparatus 20 using feed supply 37 and travels to carrier removal station 22. Typically, recording element 38 is fed into apparatus 20 by a system user. However, it is contemplated that apparatus 20 can be connected to printing system 26 using a conventional media handling or conveyance system, for example, a conveyor belt mechanism. In this configuration, feed supply 37 and the output tray of printing system 26 can be removed and replaced by the media handling or conveyance system.

Carrier removal station 22 includes transport roller 54 and a roller 56 which form a transporting nip 55. The relative positions of roller 54 and roller 56 are such that the pressure created and applied to recording element 38 by roller 54 and roller 56 is sufficient to move recording element 38 through carrier removal station 22 without significantly altering a durability characteristic of recording element 38. Carrier removal is accomplished by including one or more devices 52 that remove carrier from recording element 38. For example, device 52 can include one or more halogen lamps that produce heat which evaporates or removes carrier from recording element 38. Depending on temperature conditions inside carrier removal station 22, carrier removal station 22 can also preheat recording element 38 as recording element 38 moves toward converting station 24, using for example, heating element 62. Doing this can result in increased productivity (thru-put), for example, in apparatus 20.

Recording element 38 enters converting station 24 which includes a pressure roller 60 and a roller 56 which form a converting nip 61. The relative positions of roller 60 and roller 56 are such that the pressure created and applied to recording element 38 by roller 60 and roller 56 is sufficient to alter a durability characteristic of recording element 38 as recording element 38 travels through roller 60 and second roller 56. Recording element 38 exits treating apparatus 20 coming to rest in exit tray 63.

Depending on the contemplated application, roller 60 and/or roller 56 (and/or roller 54) can be hollow and include a heating element 62 (for example, a halogen lamp, etc.) that elevates the temperature of the converting station 24 and helps with the durability characteristic change. Typically, heating element 62 is located within roller 60 and/or roller 56. However, heating can also be included in roller 54 to preheat recording element 38, in addition to removing carrier, prior to recording element 38 reaching roller 60. Doing this decreases the temperature gradient between recording element 38 and roller 60 which can decrease the likelihood of image defects and can increase the speed at which rollers 54, 56, 60 are operated. A temperature sensor, for example temperature sensor 64 shown in FIG. 2, (connected to a temperature control device located, for example, in controller 25 of apparatus 20), can be included in the converting station 24 to monitor temperature inside the converting station 24. A shield 66, shown in FIG. 2, can also be positioned where needed to protect components of printing system 26 and/or treating apparatus 20 from excessive heat, etc.

It is recognized that the embodiments of apparatus 20 described with reference to FIGS. 6–9 can be incorporated into printing systems 26 like the embodiments described with reference to FIGS. 2–5 depending on the particular application being contemplated. Similarly, it is also recognized that the embodiments of apparatus 20 described with reference to FIGS. 2–5 can be presented as "stand alone" type devices like the embodiments described with reference to FIGS. 6–9 depending on the particular application being contemplated. Additionally, portions of the embodiments described with reference to FIGS. 6–9 and portions of the embodiments described with reference to FIGS. 1–5 can be combined to form apparatus 20.

Although carrier removal station 22 has been described as including device 52 (for example, a halogen lamp(s)) and/or device 68 (for example, a forced air convection element), carrier removal station 22 can include any means capable of removing a predetermined amount (or percentage) of carrier present in the recording element. For example, carrier removal can be (and typically is) accomplished through evaporation. As such, carrier removal station 22 can include any means for evaporating carrier. Therefore, device 52 and/or 68 can include non-contact element(s) like a forced air convection element (commonly referred to as a blower) that directs a gas, typically air, (that can be optionally heated) over the surface of the recording element, as discussed above. Device 52 and/or 68 can also include a heating element such as a halogen lamp, as discussed above; an incandescent lamp; and/or an infrared radiation element. Alternatively, device 52 and/or 68 can include a contact conduction element(s) capable of removing carrier when element is in contact with recording element 38. Therefore, device 52 and/or 68 can include a heating element that contacts one or both sides of recording element 38, for example, a heated roller, or table.

The amount (or percentage) of carrier removed typically depends on the particular application and the characteristics of the recording element 38. Generally stated, the percentage of carrier removed is the minimum amount necessary to prevent defects from occurring after the durability characteristic of recording element 38 has been altered (for example, increased) by converting station 24. Typically, at least about 50% to at least about 99% of the carrier present in printed recording element 38 is removed by carrier removal station 22, although percentages will vary depending on the application. Preferably, at least 60% of the carrier is removed, more preferably at least 70%, still more preferably at least 80%, and still more preferably at least 90% of the carrier is removed. Controller 25 can include data that optimizes operational settings depending on the desired removal percentage.

The carrier amount (or percentage) is removed while recording element 38 is in the carrier removal zone. The carrier removal zone can include the carrier removal station 22 and/or the distance between the carrier removal station 22 and the converting station 24. The distance between stations 22 and 24 is not particularly limited. As such, carrier removal station 22 can be positioned adjacent to converting station 24 or carrier removal station 22 can be positioned spaced apart from converting station 24. Generally, the carrier removal zone is optimized depending on application so that the predetermined amount (or percentage) of carrier can be removed. The appropriate length of the carrier removal zone often depends on the transport speed of recording element 38, the temperature of the carrier removal station 22, and/or the amount and nature of the carrier to be removed.

As discussed above, carrier removal station 22 can include rollers 54 and 56. Rollers 54 and/or 56 can be solid, hollow, and have equivalent or non-equivalent diameters. Diameter size of roller 54 and/or 56 can also vary depending on the application contemplated. The length of roller 54 and/or 56 is not particularly limited, but usually extends beyond the width of recording element 38 (for example, by at least about 1 cm). Device 52, for example, a carrier removal heating element such as a halogen lamp and/or an infrared radiation source, can be positioned along an axial direction of one or more roller 54 and/or 56. Device 52 can be located within one or more of roller 54 and/or 56. Alternatively, one or more roller 54 and/or 56 can be heated by a device 52 that is an external heating source positioned at a suitable distance from the surface of roller 54 and/or 56.

Roller 54 and/or 56 can be made from any material having a high thermal conductivity so as to elevate the temperature of recording element 38 and evaporate carrier. Roller 54 and/or 56 can be metal, such as stainless steel, aluminum, anodized aluminum, etc. Additionally, the surface of roller 54 and/or 56 can have a coating which reduces or prevents recording element contamination when roller 54 and/or 56 is in contact with either surface of recording element 38. The coating can also be of the type that facilitates release of recording element 38 from/through roller 54 and/or 56. The coating should also be able to efficiently conduct heat to recording element 38 when roller 54 and/or 56 are heated. Useful coatings include rubbers, silicon-containing rubbers and/or polymers, fluorine-containing polymers, oils, and the like.

When operated as a drive roller, roller 54 and/or 56 is driven by a motor or other suitable power source (not shown) and can have a built-in overdrive mechanism that, when engaged with recording element 38, overdrives the action of roller 54 and/or 56 such that transport of recording mechanism 38 is relayed from the transport rollers 47 to roller 54 and/or 56. The overdrive mechanism can be a one-way mechanism that includes driven bearings, slip-clutches, etc. The transport speed of recording element 38 typically increases slightly, after being engaged by roller 54 and/or 56. The rotational speed of transport roller 47 and roller 54 and/or 56 are driven accordingly depending on their diameters. The transport speed of recording element 38 is not particularly limited and is typically between 0.64 and 1.27 cm/sec (0.25 and 0.5 in/sec). For example, the transport speed of the inkjet print increases from 0.86 cm/sec (0.34 in/sec) when driven by transport roller 47 to about 0.89 cm/sec (0.35 in/sec) when driven by roller 54 and/or 56. As such, printing of recording element 38 should be complete prior to recording element 38 entering carrier removal station 22.

The relative positioning of roller 54 and roller 56 can vary and should be optimized depending on the contemplated application. Factors often considered when optimizing include transport speed of recording element 38; temperature of apparatus 20; characteristics of recording element 38; the amount and type of ink being deposited; and/or the amount of carrier to be removed from recording element 38. As described above, the width of transporting nip 55 is small enough that a sufficient amount of pressure is generated on recording element 38 in order to facilitate its transport but large enough so that recording element 38 is not damaged by the pressure generated by roller 54 and/or 56. As such, typical widths of transporting nip 55 usually depend on the thickness of recording element 38. In general, the amount of pressure generated on recording element 38 in the transporting nip 55 should be from about 0.07 kg/cm$^2$ (1 psi) to about 1.4 kg/cm$^2$ (20 psi), or 0.1–10 % OD of roller 56 (54) and 1–25 % OD of pressure roller 60 (56). In general, the width of transporting nip 55 should be from about 0.025 cm (0.01 in.) to about 0.13 cm (0.05 in.).

As described above, recording element 38 can enter converting station 24 at some predetermined elevated temperature in order to facilitate conversion by minimizing the amount of energy and time required for conversion. Heat shield 66 can be positioned around carrier removal station 22 and/or converting station 24 to help maintain a desired temperature in apparatus 20 so that recording element 38 can enter converting station 24 at the desired elevated temperature. Alternatively, the temperature of recording element 38 can be maintained by a heated block positioned in the carrier removal zone such that recording element 38 travels over it. Alternatively, a pre-heating station including a heating element can be positioned in the carrier removal zone. Using a pre-heating station can be desirable when the length of the carrier removal zone is long or when the temperature of recording element 38 should be higher when entering converting station 24 (as compared to the temperature of recording element 38 when it exits carrier removal station 22).

Temperature sensor mechanism 64 can be any conventional temperature sensing mechanism and is well-known to those skilled in the art. The temperature range of apparatus 20 is not particularly limited. It should be sufficient to remove the desired amount (or percentage) of carrier from recording element 38 given a particular set of system operating conditions, but low enough so that recording element 38 is not damaged. A typical temperature range is between 30° C. and 200° C.

After traveling through the carrier removal zone, recording element 38 enters converting station 24 positioned downstream from carrier removal station 22. Converting station 24 is adapted to alter (for example, increase) a durability characteristic of recording element 38. Converting station 24 can include any suitable means for altering a durability characteristic of recording element 38. For example, converting station 24 can include devices or systems that use pressure and/or heat to alter the durability characteristic of recording element 38. Alternatively, or in addition, converting station 24 can include a conventional lamination device, a conventional fusing device, etc.

Converting station 24 can include rollers 56 and/or 60. Roller 60 and/or 56 can be solid, hollow, and have equivalent or non-equivalent diameters. Diameter size of roller 54 and/or 56 can also vary depending on the application contemplated. The length of roller 60 and/or 56 is not particularly limited, but usually extends beyond the width of recording element 38 (for example, by at least about 1 cm). Device 62, for example, a carrier removal heating element such as a halogen lamp and/or an infrared radiation source, can be positioned along an axial direction of one or more roller 60 and/or 56. Device 62 can be located within one or more of roller 60 and/or 56. Alternatively, one or more roller 60 and/or 56 can be heated by a device 62 that is an external heating source positioned at a suitable distance from the surface of roller 60 and/or 56.

Roller 60 and/or 56 can be made from any material having a high thermal conductivity so as to elevate the temperature of recording element 38 and convert recording element 38. Roller 60 and/or 56 can be metal, such as stainless steel, aluminum, anodized aluminum, etc. Additionally, the surface of roller 60 and/or 56 can have a coating which reduces or prevents recording element contamination when roller 60 and/or 56 is in contact with either surface of recording element 38. The coating can also be of the type that facilitates release of recording element 38 from/through roller 60 and/or 56. The coating should also be able to efficiently conduct heat to recording element 38 when roller 60 and/or 56 are heated. Useful coatings include rubbers, silicon-containing rubbers and/or polymers, fluorine-containing polymers, oils, and the like.

When operated as a drive roller, roller 60 and/or 56 is driven by a motor or other suitable power source (not shown) and can have a built-in overdrive mechanism that, when engaged with recording element 38, overdrives the action of roller 60 and/or 56 such that transport of recording mechanism 38 is relayed from the transport rollers 47 to roller 54 and/or 56. The overdrive mechanism can be a one-way mechanism that includes driven bearings, slip-clutches, etc. The transport speed of recording element 38 typically increases slightly, after being engaged by roller 60 and/or 56. The rotational speed of transport roller 47 and roller 60 and/or 56 are driven accordingly depending on their diameters. The transport speed of recording element 38 is not particularly limited and is typically between 0.64 and 1.27 cm/sec (0.25 and 0.5 in/sec). For example, the transport speed of the inkjet print increases from 0.86 cm/sec (0.34 in/sec) when driven by transport roller 47 to about 0.89 cm/sec (0.35 in/sec) when driven by roller 60 and/or 56. As such, printing of recording element 38 should be complete prior to recording element 38 entering carrier removal station 22.

The width of the converting nip 61 can vary and can be optimized depending on the contemplated application. Factors often considered when optimizing include transport speed of recording element 38; temperature of apparatus 20; characteristics of recording element 38; the amount and type of ink being deposited; and/or the durability change desired from recording element 38. For example, if recording element 38 is to be used as a transparency in medical diagnostic imaging, then the amount of pressure must be sufficient so that recording element 38 is completely transparentized, i.e., rendered haze-free; this is especially critical if recording element 38 is opaque before it is converted by converting station 24. If recording element 38 is to be used as a photographic print, complete transparentization may be less critical, but must be sufficient such that image quality and optical density of the print are not compromised.

As described above, the width of converting nip 61 must be large enough so that a sufficient amount of pressure is generated on recording element 38 in order to facilitate its conversion, but small enough so that recording element 38 is not damaged. As such, typical widths of converting nip 61 usually depend on the thickness of recording element 38. In general, the amount of pressure generated on recording element 38 in converting nip 61 should be from about 1.8 $kg/cm^2$ (25 psi) to about 17.6 $kg/cm^2$ (250 psi). In general, the width of converting nip 61 should be from about 0.13 cm (0.05 in.) to about 1.0 cm (0.39 in.).

In certain applications, any one or combination of rollers 54, 56, 60 can be replaced by one or more belts. The belt(s) can be of any type conventionally used in the post-printing processing industry. Additionally, rollers 54, 56, and 60 can have varying degrees of hardness such that one of rollers 54, 56, and 60 deforms slightly when contacted by another of rollers 54, 56, and 60. This type of roller configuration is known in the post-printing processing industry.

Experimental Results

Inkjet Recording Element

Polymer particles used in the inkjet recording element employed in the example were prepared as followed. A 12-liter, Morton reaction flask was prepared by adding 4000 g of de-mineralized water. The flask contents were heated to 80° C. with 150 RPM stirring in a nitrogen atmosphere. The initiator solution addition flask was made up with 1974 g of de-mineralized water and 26.4 g of 2,2'-azobis(2-methylpropionamidine) dihydrochloride. A monomer phase addition flask was prepared by adding 2419 g of ethyl methacrylate and 127 g of methyl methacrylate. Then, charges to the reaction flask from each addition flask were started at 5 g per minute. The addition flasks were recharged as needed. Samples were taken at various times and the monomer phase feed was stopped when a particle size of 753 nm was reached. The charges of the redox initiator solutions were extended for 30 minutes beyond the end of the monomer phase addition to chase residual monomers. The reaction flask contents were stirred at 80° C. for one hour followed by cooling to 20° C., and filtration through a 200 μm polycloth. The mixture was concentrated to 50 wt. % solids by ultra-filtration, the particles were monodispersed at about 850 nanometers in diameter.

The inkjet recording element employed in the example consisted of a two layers coated on clear poly(ethylene terephthalate)support having a thickness of 0.175 mm. The base layer, coated directly on the support, had a thickness of approximately 8 μm (dry laydown 8.16 $g/m^2$) and consisted of 58 wt. % Witcobond® W-213 polyurethane dispersion from Witco Corp., 28 wt. % Type 4 gelatin, 12 wt. % polymer latex of (vinylbenzyl)trimethylammonium chloride and divinylbenzene (87:13 molar ratio), 1.2 wt. % bis(vinyl sulfonylmethane), and 0.8 wt. % Olin® 10G surfactant from Dixie Chemical Co. A top layer, coated on the base layer, had a thickness of approximately 49 μm (dry laydown 35.7 $g/m^2$) and consisted of 84 wt. % polymer particles described in the previous paragraph, 14 wt. % Witcobond® W-320 polyurethane dispersion from Witco Corp., 1.4 wt. % GP-50-A silicone fluid from Genesee Polymers Corp., and 0.6 wt. % Zonyl® FSN fluorosurfactant from E. I. du Pont de Nemours and Co. All weight percent values are relative to the total weight of the layer. The thickness of the top layer was 36 μm after conversion was carried out as described below.

Black Pigment Ink

A mixture of 325 g of polystyrene beads having mean diameter of 50 μm, 30.0 g of Pigment Blue 15:3 (Sun Chemical Corp.); 10.5 g of potassium oleoyl methyl taurate (KOMT) and 209.5 g of deionized water was prepared. These components were milled for 8 hours in a double walled vessel at room temperature using a high-energy media mill manufactured by Morehouse-Cowles Hochmeyer. The mixture was filtered through a 4–8 μm Buchner funnel to remove the polymeric beads, and the resulting filtrate diluted to give a cyan pigment dispersion having a 10.0 wt. % final concentration of pigment. The median particle size of the pigment was 45 nm, as determined using a MICROTRAC II Ultrafine Particle Analyzer manufactured by Leeds & Northrup. Proxel® GXL (Avecia Corp.) was added at an amount necessary to give 230 ppm concentration.

A magenta pigment dispersion was prepared the same as the cyan pigment dispersion except that Pigment Red 122 (Sun Chemical Corp.) was used instead of Pigment Blue 15:3. The final concentration of pigment was 11.6 wt. %, and the mean particle size was 12 nm. A black pigment dispersion was prepared the same as the cyan pigment dispersion except that Pigment Black 7 (Cabot Corp.) was used instead of Pigment Blue 15:3. The final concentration of pigment was 12.3 wt. %, and the mean particle size was 60 nm.

An aqueous-based black pigment ink was prepared by combining the cyan pigment dispersion at 0.83 wt. %; the magenta pigment dispersion at 1.10 wt. %; the black pigment dispersion at 2.60 wt. %; diethylene glycol at 12.5 wt. %; glycerol at 2.75 wt. %; tripropylene glycol methyl ether (Dowanol® TPM from Dow Chemical Co.) at 2.50 wt. %; Surfynol® 465 (Air Products and Chemicals, Inc.) at 0.25 wt %; TruDot™ IJ-4655, a styrene-acrylic copolymer available from MeadWestvaco Corp. at 0.17 wt. %; and water to give 100 wt. %. The total amount of carrier (water) present in the pigment black ink was 81.3 wt. %. All weight percent values are relative to the total weight of the ink.

Printing

The black pigment ink was printed using the image PROGRAF W2200 Graphic Color Printer available from Canon, U.S.A., Inc. Two clean empty cartridges having catalogue numbers BCI-1302BK and BCI-1302PM were filled with the ink and placed into the black and light magenta positions, respectively, of the printer. A test image consisting of an 7.62 by 10.16 cm single density patch was created using Adobe® PhotoShop® v7.0 software (Adobe Systems) in the 6-channel mode. The printer driver was overridden with software enabled through the PhotoShop® software such that the black pigment ink was printed from both cartridges in the Photo Paper Print Mode. The ink laydown was approximately 2.18 mg/cm$^2$ to give a carrier (water) laydown of 1.77 mg/cm$^2$. The area of the test patch was 77.4192 cm$^2$ so that the total amount of ink printed per test image was 169.00 mg, and the total amount of carrier (water) printed per test image was 137.03 mg.

Five samples of the inkjet recording element, each approximately 13 by 15 cm, were printed with the black pigment ink as described above. The weights of each of the samples were recorded before and immediately after printing and the results are given in Table 1.

Post-Printing Treatment—Carrier Removal Step

A carrier removal station consisting of an IR lamp and forced air was employed in the example. For the IR lamp, the KL100 Infrared Emitter Module available from Heraeus Noblelight, Inc. was used. This module consisted of a medium wave twintube carbon emitter with gold reflector operating at a total bank power of 2200 watts and housed in high temperature stainless steel housing. The heated length of the module was 30 cm. The emitter temperature of the IR lamp was varied by adjusting, using a standard variable autotransformer, the amount of voltage delivered to the module. Ambient forced air was delivered using an Exair® Standard Air Knife available from Exair Corp. (gap setting 0.05 mm, length 30 cm). The line pressure of the air delivered to the air knife was 4.9 kg/cm$^2$ (70 psi).

Carrier was removed from each of the five printed samples described above as follows. Immediately after printing, a printed sample was laid on a unidirectional platen, about 30 by 30 cm, and held flat by an aluminum metal frame that contacted the outer edges of the imaged inkjet recording element (but not the single density patch). The platen transported the printed sample at a rate of 2.5 cm/sec underneath the IR lamp positioned about 7.6 cm above the platen. After passing by the IR lamp, the printed sample passed underneath the air knife positioned about 11.4 cm from the IR lamp and about 7.0 cm above the platen. The air from the air knife was directed at the platen at an angle of about 20° relative to the plane of the platen such that it was blown over the complete surface of the imaged recording element. For each printed sample, the voltage delivered to the IR lamp was varied such that the amount of carrier removed varied proportionately. Each sample was weighed immediately after it passed completely by the air knife. The amount of carrier removed was determined, and the results are shown in Table 1.

Post-Printing Treatment—Converting Step

A converting station consisting of a belt-fusing system was employed in the example. Such systems are well known to those skilled in the art of electrophotographic copying and are disclosed, for example, in U.S. Pat. Nos. 5,258,256 and 5,783,348. The belt-fusing system consisted of a belt wrapped around a pair of stainless steel rollers. The belt was approximately 33 cm wide and consisted of Kapton® polyimide film (E.I. du Pont de Nemours and Co.) coated with a proprietary silicon-containing polymer provided by NexPress Solutions L.L.C. One of the stainless steel rollers was 6.9 cm in diameter and functioned as the fusing roller; the other stainless steel roller was 2.5 cm in diameter. Both rollers were 36 cm wide, and the distance between the two rollers was 23.0 cm (from center to center).

The fusing roller was positioned next to a third roller, 7.6 cm in diameter and 36 cm wide, which functioned as the pressure roller. The pressure roller was a stainless steel roller coated with silicon-rubber having a thickness of about 0.45 cm and a durometer hardness of about 85 Shore A units. The fusing and pressure rollers were positioned such that the nip width was 0.64 cm (0.25 in.) and the nip pressure was 4.6 kg/cm$^2$ (65 psi). Both the fusing and pressure rollers were hollow and were heated using lamps housed therein and along the axial direction. Temperature sensors were used to maintain constant temperature of the surfaces of the rollers, which was 149° C. for the fusing roller and 99° C. for the pressure roller. The printed sample was fed into the converting system with the image side of the media facing the belt.

After weighing each of the samples after the carrier removal step, each was passed through the belt fusing system at a transport rate of about 0.89 cm/sec and subsequently evaluated for artifacts. The results are shown in Table 1. Blistering is undesirable and appears as rough spots in which at least one of the media layers blisters or swells to form a bubble which then ruptures. Blistering is presumably caused by diffusion of water through and out of the topmost fusible layer of the media, i.e. evaporation of the water, as a result of heating during the converting step.

TABLE 1

| | | Sample Weight (mg) | | | | | |
|---|---|---|---|---|---|---|---|
| Sample # | Voltage (V) | Before Printing | Immediately After Printing | After Carrier removal Step | Change | Carrier Removed (wt. %) | Artifacts After Fusing |
| 1 | 83.4 | 5454.25 | 5623.25 | 5493.45 | 129.80 | 94.7 | none |
| 2 | 74.8 | 5520.33 | 5689.33 | 5564.32 | 125.01 | 91.2 | none |
| 3 | 65.2 | 5444.37 | 5613.37 | 5491.34 | 122.03 | 89.1 | none |
| 4 | 56.4 | 5445.62 | 5614.62 | 5497.01 | 117.61 | 85.8 | blistering |
| 5 | 48.1 | 5433.23 | 5602.23 | 5494.02 | 108.21 | 79.0 | blistering |

The above results show that the amount of carrier removed is directly proportional to the voltage supplied to the IR lamp. The lower the voltage, the lower the emitter temperature of the IR lamp and the less efficient it becomes for heating water within a printed sample. As a result, less water is removed in the carrier removal step. The above results also show that the amount of carrier removed has a direct effect on blistering during the converting step. If too much carrier remains in the sample after the carrier removal step, then blistering is observed. In this example, at least about 85 wt. % of the carrier needed to be removed in order to prevent blistering. In general, the minimum amount of carrier that needs to be removed will vary depending on the particular compositions of the ink and recording element, as well as the conditions employed in the carrier removal and converting steps.

The invention has been described in detail with particular reference to certain example embodiments thereof, but it will be understood that variations and modifications can be effected within the scope of the invention.

What is claimed is:

1. An apparatus for treating a recording element having an inherent durability characteristic that is capable of being increased and including a carrier that can be removed from the recording element, said apparatus comprising:

a carrier removal station adapted to remove a predetermined percentage of the carrier from the recording element; and a converting station positioned downstream from the carrier removal station adapted to increase the inherent durability characteristic of the recording element, wherein the carrier removal station is further adapted to remove the predetermined percentage of the carrier from the recording element a minimum amount necessary to prevent blistering of the recording element at the converting station when the inherent durability characteristic of the recording element is increased at the converting station.

2. The apparatus according to claim 1, wherein the carrier removal station is positioned adjacent to the converting station.

3. The apparatus according to claim 1, wherein a preheating station is positioned between the carrier removal station and the converting station.

4. The apparatus according to claim 1, wherein the converting station comprises a pair of rollers positioned to apply pressure to the recording element which is sufficient to increase the inherent characteristic of the recording element.

5. The apparatus according to claim 4, wherein the converting station comprises a heat source.

6. The apparatus according to claim 1, wherein the carrier removal station includes an exhaust fan for removing the carrier.

7. The apparatus according to claim 1, wherein the carrier removal station includes a cooling air flow on the media to prevent cracking and deformation of the media by the heating element.

8. An apparatus for treating a recording element having a durability characteristic, comprising:

a carrier removal station adapted to remove a predetermined percentage of a carrier present in the recording element;

a converting station positioned downstream from the carrier removal station adapted to increase a durability characteristic of the recording element; and a preheating station positioned between the carrier removal station and the converting station, wherein the predetermined percentage of the carrier that is removed from the recording element by the carrier removal station is a minimum amount necessary to prevent blistering of the recording element at the converting station when the inherent durability characteristic of the recording element is increased at the converting station.

9. The apparatus according to claim 1, further comprising a controller electrically connected to at least one of the carrier removal station and the converting station, wherein an operating parameter of at least one of the carrier removal station and the converting station is adjustable.

10. The apparatus according to claim 9, wherein the operating parameter is adjustable by a user.

11. The apparatus according to claim 9, wherein the operating parameter is adjustable by the controller based on criteria stored in the controller.

12. An apparatus for treating a recording element comprising:

a carrier removal station adapted to remove a predetermined percentage of a carrier present in the recording element; and a converting station positioned downstream from the carrier removal station adapted to increase a durability characteristic of the recording element;

wherein an operating parameter of the carrier removal station is adjustable to adjust the percentage of the carrier to be removed from the recording element.

13. An apparatus for treating a recording element comprising:.

a carrier removal station adapted to remove a predetermined percentage of a carrier present in the recording element;

a converting station positioned downstream from the carrier removal station adapted to increase a durability characteristic of the recording element; and a controller adjusts the percentage of the carrier removed from the recording element based on a characteristic of the recording element.

14. A method of treating a recording element having an inherent durability characteristic that is capable of being increased and including a carrier that can be removed from the recording element, said method comprising:

removing a predetermined percentage of the carrier from the recording element in a carrier removal station; and thereafter increasing the inherent durability characteristic of the recording element in a converting station distinct from the carrier removal station, wherein the predetermined percentage of the carrier that is removed from the recording element by the carrier removal station is a minimum amount necessary to prevent blistering of the recording element at the converting station when the inherent durability characteristic of the recording element is increased at the converting station.

15. The method according to claim 14, wherein increasing the durability characteristic includes applying pressure to the recording element.

16. The method according to claim 14, wherein increasing the durability characteristic includes applying heat to the recording element.

17. The method according to claim 14, wherein removing the predetermined percentage of carrier includes applying heat to the recording element.

18. The method according to claim 14, wherein removing the predetermined percentage of carrier includes applying air flow to the recording element.

19. A method of treating a recording element comprising:

removing a predetermined percentage of a carrier present in the recording element in a carrier removal station;

increasing a durability characteristic of the recording element in a converting station, wherein the carrier removal station is distinct from the carrier removal station; and preheating the recording element between removing the predetermined percentage of the carrier at the carrier removal station and increasing the durability characteristic of the recording element at the converting station, wherein the predetermined percentage of the carrier that is removed from the recording element by the carrier removal station is a minimum amount necessary to prevent blistering of the recording element at the converting station when the inherent durability characteristic of the recording element is increased at the converting station.

20. A method of treating a recording element comprising:

removing a predetermined percentage of a carrier present in the recording element in a first station;

increasing a durability characteristic of the recording element in a second station, wherein the second station is distinct from the first station; and preheating the recording element between removing the predetermined percentage of the carrier and increasing the durability characteristic of the recording element; and controlling the percentage of carrier removed from the recording element.

21. A method of treating a recording element comprising:

removing a predetermined percentage of a carrier present in the recording element in a first station; and increasing a durability characteristic of the recording element in a second station, wherein the second station is distinct from the first station;

wherein an operating parameter of the first station is adjustable to adjust the percentage of carrier to be removed from the recording element.

22. The method according to claim 21, wherein adjusting the percentage of carrier removed is accomplished by a user.

23. The method according to claim 21, wherein adjusting the percentage of carrier removed is accomplished by a controller.

24. A method of treating a recording element comprising:

removing a predetermined percentage of a carrier present in the recording element in a first station;

increasing a durability characteristic of the recording element in a second station, wherein the second station is distinct from the first station; and adjusting the percentage of the carrier removed based on a characteristic of the recording element.

* * * * *